US007641765B2

(12) United States Patent
Blum et al.

(10) Patent No.: US 7,641,765 B2
(45) Date of Patent: Jan. 5, 2010

(54) METHOD FOR PRODUCTION OF COATED PAPER WITH EXTREME WHITENESS

(75) Inventors: Thierry Blum, Neustadt (DE); Friedrich Linhart, Heidelberg (DE); Stephan Frenzel, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1035 days.

(21) Appl. No.: 10/486,105

(22) PCT Filed: Aug. 7, 2002

(86) PCT No.: PCT/EP02/08813

§ 371 (c)(1), (2), (4) Date: Feb. 9, 2004

(87) PCT Pub. No.: WO03/016624

PCT Pub. Date: Feb. 27, 2003

(65) Prior Publication Data

US 2004/0154764 A1 Aug. 12, 2004

(30) Foreign Application Priority Data

Aug. 13, 2001 (DE) ..... 101 38 631

(51) Int. Cl.
*D21H 23/22* (2006.01)
*D21H 23/76* (2006.01)
*D21H 21/30* (2006.01)
*D21H 19/80* (2006.01)

(52) U.S. Cl. ..... 162/137; 162/162; 162/168.2; 162/158; 162/175; 162/177; 162/169; 428/195.1; 427/391

(58) Field of Classification Search ..... 162/135–137, 162/158, 162, 166, 164.6, 168.1–168.2, 164.1, 162/169, 175, 177; 106/499; 427/361, 391, 427/395; 428/195, 327, 328, 32.1, 32.15, 428/195.1, 144, 340–341
See application file for complete search history.

(56) References Cited

U.S. PATENT DOCUMENTS

| | | | | |
|---|---|---|---|---|
| 3,597,314 | A | 8/1971 | Ulmschneider et al. | |
| 3,708,289 | A * | 1/1973 | Timmerman et al. | 430/62 |
| 4,880,497 | A * | 11/1989 | Pfohl et al. | 162/135 |
| 5,266,078 | A | 11/1993 | Welkener et al. | |
| 5,373,076 | A * | 12/1994 | Pinschmide et al. | 526/303.1 |
| 5,622,749 | A | 4/1997 | Rohringer et al. | |
| 5,753,759 | A | 5/1998 | Hartmann et al. | |
| 5,824,129 | A * | 10/1998 | Struckmeier et al. | 65/207 |
| 5,911,855 | A * | 6/1999 | Dransmann et al. | 162/135 |
| 5,939,469 | A * | 8/1999 | Fussnegger et al. | 523/161 |
| 6,132,558 | A * | 10/2000 | Dyllick-Brenzinger et al. | 162/164.6 |
| 6,352,341 | B2 * | 3/2002 | Kovacs et al. | 347/101 |
| 6,454,404 | B1 * | 9/2002 | Lawrence et al. | 347/100 |
| 6,605,325 | B2 * | 8/2003 | Lawrence et al. | 428/32.24 |
| 6,635,319 | B1 * | 10/2003 | Sunderrajan et al. | 428/32.15 |
| 6,710,175 | B2 * | 3/2004 | Anderson et al. | 536/45 |
| 6,969,444 | B2 * | 11/2005 | Linhart et al. | 162/135 |
| 2001/0051687 | A1 * | 12/2001 | Bazaj et al. | 525/218 |
| 2003/0013800 | A1 * | 1/2003 | Kothrade et al. | 524/555 |
| 2003/0064208 | A1 * | 4/2003 | Yamada et al. | 428/195 |
| 2003/0131962 | A1 * | 7/2003 | Lindsay et al. | 162/168.2 |
| 2003/0177690 | A1 * | 9/2003 | Wittkowski et al. | 44/386 |
| 2003/0219539 | A1 * | 11/2003 | Nigam | 427/372.2 |
| 2004/0020615 | A1 * | 2/2004 | Linhart et al. | 162/135 |
| 2004/0149407 | A1 * | 8/2004 | Chen et al. | 162/158 |
| 2004/0154764 | A1 * | 8/2004 | Blum et al. | 162/135 |
| 2004/0182533 | A1 * | 9/2004 | Blum et al. | 162/135 |
| 2004/0256066 | A1 * | 12/2004 | Lindsay et al. | 162/135 |
| 2005/0061461 | A1 * | 3/2005 | Linhart et al. | 162/158 |

FOREIGN PATENT DOCUMENTS

| | | | |
|---|---|---|---|
| DE | 4409903 | A1 * | 9/1995 |
| DE | 19727503 | A1 * | 1/1999 |
| DE | 10055592 | | 5/2002 |
| EP | 1022383 | | 7/2000 |
| WO | WO 9900437 | A1 * | 1/1999 |
| WO | WO 01/21891 | | 3/2001 |
| WO | WO 0238861 | A1 * | 5/2002 |
| WO | WO 03016624 | A1 * | 2/2003 |
| WO | WO 03021041 | A2 * | 3/2003 |
| WO | WO 03046024 | A1 * | 6/2003 |
| WO | WO 2005033402 | A1 * | 4/2005 |

OTHER PUBLICATIONS

U.S. Appl. No. 10/415,338, filed May 2, 2003, Linhart, et al.
Muller, et al., "Fluorescent whiteners—New discoveries regarding their properties and behaviour in paper", Paper Southern Africa, vol. 13, No. 2, pp. 4, 8, 10, 12, 14, 16, 18 and 22, Apr. 1993.
H. G. Hans Georg Oesterlin, "Optische Aufhellung gestrichener Papiere—aktiviert mit® Mowiol", Kunstharz-nachrichten, vol. 18, pp. 13-17, 1982.
H. W. Louman, "Optische Aufheller in gestrichenem Papier" Wochenblatt Für Papierfabrikation, 114:7, pp. 241-245, 1986.
J. D. Barnard, "The role of OBAs and cross linking agents", Paper Technology, 33:9, pp. 24-30, Sep. 1992.

* cited by examiner

*Primary Examiner*—José A Fortuna
(74) *Attorney, Agent, or Firm*—Oblon, Spivak, McClelland, Maier & Neustadt, L.L.P.

(57) ABSTRACT

Paper coated with a coating slip containing at least one optical brightener is produced by a process in which base paper or precoated paper is treated, before application of the coating slip containing optical brightener, with at least one substance which enhances the efficiency of optical brighteners.

13 Claims, No Drawings

METHOD FOR PRODUCTION OF COATED PAPER WITH EXTREME WHITENESS

BACKGROUND OF INVENTION

1 Field of Invention

The present invention relates to a novel process for the production of coated paper which has a particularly high degree of whiteness. The present invention furthermore relates to papers which are produced by this process and the printing of papers which are produced by this process.

2 Description of the Background

Paper coating slips substantially comprise a generally white pigment, a polymeric binder and additives which, for example, influence the rheological properties of the coating slip and the properties of the surface of the coated paper in the desired manner. Such additives are frequently also referred to as cobinders. By means of the binder, the pigments are fixed on the paper and the cohesiveness in the resulting coating is ensured.

Base papers acquire a smooth, uniformly white surface as a result of coating with paper coating slips. The paper coating slips additionally result in an improvement in the printability of the paper. In order to obtain optimum qualities, papers are frequently also coated two or three times, i.e. a coating slip is applied a second or a third time to a precoated paper.

The coating of paper with paper coating slips is well known nowadays, cf. for example The Essential Guide to Aqueous Coating of Paper and Board, T. W. R. Dean (ed.), published by the Paper Industry Technical Association (PITA), 1997.

One of the most important objects of coating paper with coating slips is to increase the whiteness of the paper. The object for a person skilled in the art is to provide paper having improved properties, in particular having greater whiteness, by coating uncoated paper, which is also referred to below as coating paper or base paper, or by coating precoated paper.

For this purpose, fluorescent brighteners (fluorescent or phosphorescent dyes) or optical brighteners are added to the coating slip, in particular that which is to form the top coat. Said brighteners are dye-like fluorescent compounds which absorb the short-wave, ultraviolet light invisible to the human eye and emit it again as longer-wavelength blue light, with the result that the human eye perceives a greater whiteness, so that the whiteness is increased.

The optical brighteners used in the paper industry are generally 1,3,5-triazinyl derivatives of 4,4'-diaminostilbene-2,2'-disulfonic acid, which may carry additional sulfo groups. An overview of such brighteners is to be found, for example, in Ullmann's Encyclopedia of Industrial Chemistry, Sixth Edition, 2000 Electronic Release, OPTICAL BRIGHTENERS—Chemistry of Technical Products. However, more recent brightener types are also suitable, for example derivatives of 4,4'-distyrylbiphenyl, as likewise described in the abovementioned Ullmann's Encyclopedia of Industrial Chemistry.

However, the use of optical brighteners in the coating slip leads to optimum success only when they are present in the final coating of the paper in an optimum structure, conformation and distribution, since, for example in the case of stilbenes, only the trans form is optically active and it only exhibits maximum fluorescence when it is distributed in monomolecular form and is fixed in a plane (K. P. Kreutzer, Grundprozesse der Papiererzeugung 2: Grenzflächenvorgänge beim Einsatz chemischer Hilfsmittel, H.-G. Völkel and R. Grenz (editors), PTS Munich, 2000, PTS manuscript: PTS-GPE—SE 2031-2). In order to achieve this, polymeric compounds which enhance the effect of the optical brightener in the coating slip and are referred to as activators or carriers are added to the paper coating slip. To date, these activators have always been mixed with the paper coating slip. An important function of the cobinders mentioned at the outset in coating slips is their brightener-activating effect. Suitable cobinders which may be used are water-soluble polymers, e.g. polyvinyl alcohol, carboxymethylcellulose, anionic or nonionic degraded starches, casein, soybean protein, water-soluble styrene/acrylate copolymers and acrylate-containing copolymers (cf. for example K. P. Kreutzer, loc. cit.).

All these compounds, which are referred to below as activators, are polymeric compounds which have the problem that they increase the viscosity of the coating slips. Consequently, an increase in the amount in which they are used in order to obtain greater whiteness is subject to narrow limits. Paper coating slips comprising polymers and copolymers which contain N-vinylformamide in the form of polymerized units, as described in the German application with the application number 100 55 592.6, are particularly effective with regard to the activation of optical brighteners.

SUMMARY OF THE INVENTION

It is an object of the present invention to provide a method by means of which the whiteness of coated paper can be increased.

We have found that this object is achieved by a process for the production of paper coated with a coating slip containing at least one optical brightener, in which base paper or precoated paper is treated, before application of the coating slip containing optical brightener, with at least one substance which enhances the efficiency of optical brighteners.

DETAILED DESCRIPTION OF THE PREFERRED EMBODIMENTS

It is surprising that the considerable increase in the whiteness is obtained even when the brightener-containing coating slip itself contains no activator for the optical brightener.

It has furthermore been found that polymers and copolymers, referred to below as (co)polymers, which contain at least one N-vinylcarboxamide, for example of the formula (I), in the form of polymerized units, result in a particularly pronounced improvement in the properties of the coated paper if they are applied according to the invention to the base paper or precoated paper before the paper is coated with a coating slip which contains at least one optical brightener. In particular, brightness and/or whiteness are increased.

(I)

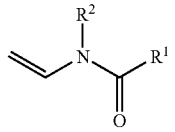

In formula I, $R^1$ and $R^2$, independently of one another, are hydrogen or $C_1$- to $C_{20}$-alkyl, it being possible for the alkyl radical to be straight-chain or branched.

$R^1$ and $R^2$, independently of one another, are preferably hydrogen or $C_1$- to $C_{10}$-alkyl, particularly preferably hydrogen or $C_1$- to $C_4$-alkyl, very particularly preferably hydrogen or methyl, in particular hydrogen.

$R^1$ and $R^2$ may also together form a straight or branched chain of 2 to 8, preferably 3 to 6, particularly preferably 3 to 5, carbon atoms. If required, one or more carbon atoms may be replaced by hetero atoms, e.g. oxygen, nitrogen or sulfur.

Examples of $R^1$ and $R^2$ are methyl, ethyl, isopropyl, n-propyl, n-butyl, isobutyl, sec-butyl, tert-butyl, n-hexyl, n-heptyl, 2-ethylhexyl, n-octyl, n-decyl, n-undecyl, n-dodecyl, n-tetradecyl, n-hexadecyl, n-octadecyl and n-eicosyl.

Examples of $R^1$ and $R^2$ which together form a chain are 1,2-ethylene, 1,2-propylene, 1,3-propylene, 2-methyl-1,3-propylene, 2-ethyl-1,3-propylene, 1, 4-butylene, 1,5-pentylene, 2-methyl-1,5-pentylene, 1,6-hexylene and 3-oxa-1,5-pentylene.

Examples of such N-vinylcarboxamides of the formula (I) are N-vinylformamide, N-vinylacetamide, N-vinylpropionamide, N-vinylbutyramide, N-vinylisobutyramide, N-vinyl-2-ethylhexanamide, N-vinyldecanamide, N-vinyldodecanamide, N-vinylstearamide, N-methyl-N-vinylformamide, N-methyl-N-vinylacetamide, N-methyl-N-vinylpropionamide, N-methyl-N-vinylbutyramide, N-methyl-N-vinylisobutyramide, N-methyl-N-vinyl-2-ethylhexanamide, N-methyl-N-vinyldecanamide, N-methyl-N-vinyldodecanamide, N-methyl-N-vinylstearamide, N-ethyl-N-vinylformamide, N-ethyl-N-vinylacetamide, N-ethyl-N-vinylpropionamide, N-ethyl-N-butyramide, N-ethyl-N-vinylisobutyramide, N-ethyl-N-vinyl-2-ethylhexanamide, N-ethyl-N-vinyldecanamide, N-ethyl-N-vinyldodecanamide, N-ethyl-N-vinylstearamide, N-isopropyl-N-vinylformamide, N-isopropyl-N-vinylacetamide, N-isopropyl-N-vinylpropionamide, N-isopropyl-N-vinylbutyramide, N-isopropyl-N-vinylisobutyramide, N-isopropyl-N-vinyl-2-ethylhexanamide, N-isopropyl-N-vinyldecanamide, N-isopropyl-N-vinyldodecanamide, N-isopropyl-N-vinylstearamide, N-n-butyl-N-vinylformamide, N-n-butyl-N-vinylacetamide, N-n-butyl-N-vinylpropionamide, N-n-butyl-N-vinylbutyramide, N-n-butyl-N-vinylisobutyramide, N-n-butyl-N-vinyl-2-ethylhexanamide, N-n-butyl-N-vinyldecanamide, N-n-butyl-N-vinyldodecanamide, N-n-butyl-N-vinylstearamide, N-vinylpyrrolidone and N-vinylcaprolactam.

N-Vinylformamide, N-vinylacetamide, N-methyl-N-vinylformamide, N-methyl-N-vinylacetamide, N-vinylpyrrolidone and N-vinylcaprolactam are preferred, N-vinylformamide being particularly preferred.

Even if the precoated or uncoated paper is treated with other water-soluble compounds known as activators for optical brighteners before the coating with the coating slip which contains at least one optical brightener, an increase in the brightness and the whiteness of the coated paper is obtained according to the invention.

Examples of such activators are polyvinyl alcohol, carboxymethylcellulose, anionic or nonionic degraded starches, casein, soybean protein, water-soluble styrene/acrylate copolymers and acrylate-containing copolymers.

For example, it is possible to use as activators those polyvinyl alcohols which have degrees of polymerization of about 500-2 500, corresponding to molar masses of about 20 000-100 000 g/mol. The degrees of hydrolysis of the polyvinyl alcohols which can be used according to the invention are as a rule at least 70 mol %, and preferred polyvinyl alcohols have a degree of hydrolysis of either 98-99 or 87-89 mol % and, as generally partially hydrolyzed polyvinyl acetates, have a residual content of about 1-2 or 11-13 mol % of acetyl groups.

The polyvinyl alcohols which can be used according to the invention have predominantly 1,3-diol units, the content of 1,2-diol units being as a rule less than 2%, preferably less than 1%.

Here, polyvinyl alcohol is understood as meaning a polymer which contains at least 10, preferably at least 20, particularly preferably at least 50, in particular at least 90, % by weight, based on the polymer, of vinyl acetate in polymerized and, if required, cleaved form.

Those polyvinyl alcohols which are commercially available under the trade names Mowiol® (Clariant AG), Polyviol® (Wacker-Chemie GmbH), Rhodoviol® (Rhodia), Alcotex® (Revertex), Polivinol® (Rhodiatoce), Denka Poval® (Denki Kagaku Kogyo), Gohsenol® (Nippon Gohsei), Kurashiki Poval® (Kuraray), Shinetsu Poval® (Shinetsu Chem. Ind.), Unitika Poval® (Unitika), Elvanol® (Du Pont), Gelvatol® (Shawinigan Resins) and Lemol® (Borden) are particularly suitable, the Mowiol®, Polyviol® and Rhodoviol® grades being particularly preferred.

Carboxymethylcellulose products which may be used according to the invention as activators are those which have a molar mass of from 50 000 to 500 000 g/mol. The carboxymethylcellulose can be used in the form of the sodium salt or of the free acid or as a mixture thereof, preferably in the form of the sodium salt. The degree of substitution of carboxymethyl groups per anhydroglucose unit may be from 0.5 to 1.5.

Examples of anionic or nonionic degraded starches which can be used according to the invention as activators are hydroxyethyl, hydroxypropyl, methyl, ethyl or carboxymethyl starches which have a molar mass of from 50 000 to 2 000 000 g/mol.

Acrylate-containing copolymers are understood here as meaning copolymers which contain at least 10, preferably at least 20, particularly preferably at least 50, in particular at least 70, % by weight, based on the copolymer, of at least one acrylate in the form of polymerized units, for example methyl acrylate, ethyl acrylate, n-butyl acrylate and 2-ethylhexyl acrylate. Further monomers which can be present are, for example, acrylic acid, methacrylic acid, acrylonitrile, vinyl acetate, vinyl propionate, N-vinylformamide, allylacetic acid, vinylacetic acid, maleic acid, fumaric acid, N-vinylpyrrolidone or hydroxybutyl vinyl ether in the form of polymerized units. These acrylate-containing copolymers may be used, for example, in the form of their aqueous solutions or dispersions having a copolymer content of from 10 to 75, preferably from 20 to 60, % by weight.

The Acrosol® grades from BASF AG are preferably used here, for example Acrosol® A30D, A40D, B37D, C50L or E20D, preferably Acrosol® C50L.

According to the invention, polyvinyl alcohols and/or (co)polymers which contain N-vinylcarboxamides in the form of polymerized units are preferably used, particularly preferably (co)polymers which contain monomers of the formula (I) in the form of polymerized units.

The preparation of the activators suitable for the novel process is known per se.

For example, the preparation of the polymers and copolymers of N-vinylformamide ($R^1$=$R^2$=H in (I)) which can be used for the novel process is described in EP-B1 71 050.

The synthesis of N-alkyl-N-vinylcarboxamides and their polymers and copolymers is also known or is effected by known methods, cf. for example Kirk-Othmer, Encyclopedia of Chemical Technology, 4th Edition, Volume 24, J. Wiley & Sons, NY, 1995, N-vinylamide polymers, page 1070; Uchino, N., Machida, S., Japan. Kokai JP 51100188 (C.A. 86:73393) or DE-A 42 41 117.

The preparation of polymers and copolymers of N-vinylpyrrolidone is known, for example, from Handbook of Water-Soluble Gums and Resins, Robert L. Davidson ed., McGraw-Hill, New York, 1980.

Polyvinyl alcohol has been produced on an industrial scale since 1939 and has been used for many decades in papermaking (Handbook of Water-Soluble Gums and Resins, Robert L. Davidson ed., McGraw-Hill, New York, 1980).

The (co)polymers which can be used according to the invention are obtainable, for example, by (co)polymerization of a) from 5 to 100 mol % of one or more N-vinylcarboxamides, for example of the formula (I),
b) from 0 to 95 mol % of monoethylenically unsaturated carboxylic acids of 3 to 8 carbon atoms and/or their alkali metal and ammonium salts and, if required,
c) up to 30 mol % of other monoethylenically unsaturated compounds which are copolymerizable with the monomers a) and b) and, if required,
d) up to 2 mol % of compounds which have at least two ethylenically unsaturated nonconjugated double bonds in the molecule, the sum always being 100 mol %, and, if required, subsequently elimination of some or all of the carboxyl groups from the N-vinylcarboxamides incorporated as polymerized units in the (co)polymer, with formation of amino or ammonium groups, respectively.

Examples of suitable monomers of group a) are the above-mentioned N-vinylcarboxamides of the formula (I).

For the preparation of the copolymers, said monomers can be used either alone or as a mixture with one another. From this group of monomers, N-vinylacetamide, N-methyl-N-vinylformamide, N-methyl-N-vinylacetamide, N-vinylpyrrolidone or N-vinylcaprolactam are preferably used, particularly preferably N-vinylformamide. The copolymers contain the monomers of group a) in amounts of from 5 to 100, preferably from 30 to 100, mol % in the form of polymerized units.

Suitable monomers of group b) are monoethylenically unsaturated carboxylic acids of. 3 to 8 carbon atoms and the water-soluble salts of these monomers. This group of monomers includes, for example, acrylic acid, methacrylic acid, dimethylacrylic acid, ethacrylic acid, maleic acid, citraconic acid, methylenemalonic acid, allylacetic acid, vinylacetic acid, crotonic acid, fumaric acid, mesaconic acid and itaconic acid. From this group of monomers, acrylic acid, methacrylic acid, maleic acid or mixtures of said carboxylic acids are preferably used, in particular mixtures of acrylic acid and maleic acid or mixtures of acrylic acid and methacrylic acid. The monomers of group b) can be used either in the form of free carboxylic acids or in partly or completely neutralized form in the copolymerization. For example, alkali metal bases, alkaline earth metal bases, ammonia or amines, e.g. sodium hydroxide solution, potassium hydroxide solution, sodium carbonate, potassium carbonate, sodium bicarbonate, magnesium oxide, calcium hydroxide, calcium oxide, ammonia, triethylamine, ethanolamine, diethanolamine, triethanolamine, morpholine, diethylenetriamine or tetraethylenepentamine, are used for neutralizing the monoethylenically unsaturated carboxylic acids. The copolymers contain at least one monomer from group b) in an amount of from 95 to 0, preferably from 70 to 0, mol % in the form of polymerized units.

The copolymers of the monomers a) and b) can, if required, be modified by using in the copolymerization at least one other monoethylenically unsaturated compound which is copolymerizable with the monomers a) and b). Suitable monomers of group c) are, for example, the esters, amides and nitriles of carboxylic acids stated under a), e.g. methyl acrylate, ethyl acrylate, methyl methacrylate, ethyl methacrylate, hydroxyethyl acrylate, 2- or 3-hydroxypropyl acrylate, 2- or 4-hydroxybutyl acrylate, hydroxyethyl methacrylate, 2- or 3-hdyroxypropyl methacrylate, hydroxyisobutyl acrylate, hydroxyisobutyl methacrylate, monomethyl maleate, dimethyl mealate, monoethyl maleate, diethyl maleate, 2-ethylhexyl acrylate, 2-ethylhexyl methacrylate, acrylamide, methacrylamide, N-dimethylacrylamide, N-tert-butylacrylamide, acrylonitrile, methacrylonitrile, dimethylaminoethyl acrylate, dimethylaminoethyl methacrylate, diethylaminoethyl acrylate, diethylaminoethyl methacrylate and the salts of the last-mentioned monomers with carboxylic acids or mineral acids and the quaternized products. Also suitable as monomers of group c) are acrylamidoglycolic acid, vinylsulfonic acid, allylsulfonic acid, methallylsulfonic acid, styrenesulfonic acid, 3-sulfopropyl acrylate, 3-sulfopropyl methacrylate and acrylamidomethylpropanesulfonic acid and monomers containing phosphonic acid groups, such as vinyl phosphate, allyl phosphate and acrylamidomethanepropanephosphonic acid. Further suitable compounds of this group are N-vinyl-2-methylimidazoline, diallylammonium chloride, vinyl acetate and vinyl propionate. It is of course also possible to use mixtures of said monomers of group c), for example mixtures of acrylate and vinyl acetate, mixtures of different acrylates, mixtures of acrylates and acrylamide or mixtures of acrylamide and hydroxyethyl acrylate of the monomers of group c), acrylamide, acrylonitrile, vinyl acetate, N-vinylimidazole or mixtures of these monomers, for example mixtures of acrylamide and vinyl acetate or mixtures of acrylamide and acrylonitrile, are preferably used. If the monomers of group c) are used for modifying the copolymers, they are present in the form of polymerized units in amounts of up to 30, preferably from 1 to 20, mol % in the copolymers.

The copolymers of the monomers a) and b) and, if required, c) can furthermore be modified by carrying out the copolymerization in the presence of at least one monomer of group d) which is a compound which has at least two ethylenically unsaturated nonconjugated double bonds in the molecule. The presence of the monomers of group d) in the copolymerization results in an increase in the K values (see below) of the copolymers. Suitable compounds of the group d) are, for example, methylenebisacrylamide, esters of acrylic acid and methacrylic acid with polyhydric alcohols, such as glycol diacrylate, glyceryl triacrylate, glycol dimethacrylate, glyceryl trimethacrylate and polyethylene glycols or polyols, such as pentaerythritol and glucose, which are at least diesterified with acrylic acid or methacrylic acid. Suitable crosslinking agents are additionally divinylbenzene, divinyldioxane, pentaerythrityl triallyl ether and pentaallylsucrose. From this group of compounds, water-soluble monomers, such as glycol diacrylate or glycol diacrylates of polyethylene glycols having a molecular weight of up to 3 000, are preferably used. If the monomers of group d) are used for modifying the copolymers, the amounts used are up to 2 mol %. If they are used, they are present in the form of polymerized units, preferably in an amount of from 0.01 to 1 mol % in the copolymers.

The use of compounds which are obtainable by (co)polymerization of a) from 30 to 100 mol % of N-vinylformamide, N-vinylacetamide, N-methyl-N-vinylformamide, N-methyl-N-vinylacetamide, N-vinylpyrrolidone or N-vinylcaprolactam or mixtures thereof,
b) from 70 to 0 mol % of acrylic acid, methacrylic acid and/or their alkali metal, alkaline earth metal, ammonium or amine salts or mixtures thereof and
c) from 0 to 30 mol % of acrylamide, acrylonitrile, vinyl acetate, N-vinylimidazole or mixtures thereof, the sum always being 100 mol %, and, if required, subsequent partial or complete hydrolysis of the polymerized N-vinylcarboxamide units is preferred.

Examples are homopolymers of N-vinylformamide, copolymers of N-vinylformamide, acrylic acid and acrylamide, copolymers of N-vinylformamide, acrylic acid and acrylonitrile, copolymers of N-vinylformamide, acrylic acid and vinyl acetate, copolymers of N-vinylformamide, acrylic acid and N-vinylpyrrolidone, copolymers of N-vinylformamide, acrylic acid, acrylonitrile and vinyl acetate, and copolymers of N-vinylformamide, acrylic acid, acrylamide and acrylonitrile. In the copolymers described last, some or all of the acrylic acid can be replaced by methacrylic acid. Acrylic acid or methacrylic acid can be partly or completely neutralized with sodium hydroxide solution, potassium hydroxide solution, calcium hydroxide or ammonia.

The copolymers are prepared by known free radical processes, for example solution, precipitation, suspension or emulsion polymerization using compounds which form free radicals under the polymerization conditions.

The polymerization temperatures are usually from 30 to 200° C., preferably from 40 to 110° C., particularly preferably from 40 to 100° C., if required under reduced or superatmospheric pressure. Suitable initiators are, for example, azo and peroxy compounds and the conventional redox initiator systems, such as combinations of hydrogen peroxide and reducing compounds, e.g. sodium sulfite, sodium bisulfite, sodium formaldehyde sulfoxylate and hydrazine. These systems can, if required, additionally contain small amounts of a heavy metal salt.

The copolymers are preferably prepared by solution polymerization in water, the monomers of group b) preferably being used in salt form and the pH during the polymerization being kept at from 4 to 10, preferably from 6 to 8. In order to keep the pH constant during the copolymerization, it is expedient to add small amounts, e.g. from 0.5 to 2% by weight, of a buffer, for example disodium hydrogen phosphate. Preferably used polymerization initiators are water-soluble azo compounds, such as 2,2'-azobis(2-methylpropionamidine) dihydrochloride, 2,2'-azobis(4-methoxy-2,4-dimethylvaleronitrile), 2,2'-azobis(2-methyl-N-phenylpropionamidine) dihydrochloride, 2,2'-azobisisobutyronitrile, 2,2'-azobis(2-amidinopropane) hydrochloride or 4,4'-azobis(4'-cyanopentanoic acid).

Said compounds are generally used in the form of aqueous solutions or dispersions, the lower concentration being determined by the amount of water acceptable in the (co)polymerization and the upper concentration by the solubility of the relevant compound in water. In general, the concentration is from 0.1 to 30, preferably from 0.5 to 20, particularly preferably from 1.0 to 10, % by weight, based on the solution.

The amount of the initiators is in general from 0.1 to 10, preferably from 0.5 to 5, % by weight, based on the monomers to be (co)polymerized. A plurality of different initiators may also be used in the (co)polymerization.

For example, water, alcohols, such as methanol, ethanol, n-propanol, isopropanol, n-butanol or isobutanol, or ketones, such as acetone, methyl ethyl ketone, diethyl ketone or methyl isobutyl ketone, may serve as solvents or diluents.

In order to prepare low molecular weight copolymers, the copolymerization is carried out in the presence of a regulator. Suitable regulators are, for example, secondary alcohols, such as isopropanol and sec-butanol, hydroxylamine, formic acid and mercapto compounds, such as mercaptoethanol, mercaptopropanol, mercaptobutanol, thioglycolic acid, thiolactic acid, tert-butyl mercaptan, octyl mercaptan and dodecyl mercaptan. The regulators are usually used in amounts of from 0.01 to 5% by weight, based on the monomers used. If secondary alcohols are used as regulators, the polymerization can also be effected in the presence of substantially larger amounts, for example up to 80% by weight, based on the monomers. In these cases, the secondary alcohols are simultaneously solvents for the monomers.

The (co)polymers thus obtainable have K values of from 30 to 300, preferably from 50 to 250. The K values are determined according to H. Fikentscher in 5% strength aqueous sodium chloride solution at pH 7, 25° C. and a polymer concentration of 0.1% by weight.

However, the (co)polymerization can also be carried out in another manner known per se to a person skilled in the art, for example as a solution, precipitation, water-in-oil emulsion or inverse suspension polymerization. Solution polymerization is preferred.

In the emulsion polymerization, ionic and/or nonionic emulsifiers and/or protective colloids or stabilizers are used as surface-active compounds.

Depending on the polymerization conditions, (co)polymers having different molecular weights, which are characterized in this document with the aid of the K values according to Fikentscher, are obtained in the (co)polymerization. (Co)polymers having a high K value, for example above 80, are preferably prepared by (co)polymerization of the N-alkyl-N-vinylcarboxamide (I) in water. (Co)polymers having a high K value are furthermore obtained, for example, by (co)polymerization of the monomers by inverse suspension polymerization or by (co)polymerization of the monomers by the water-in-oil polymerization method.

In the inverse suspension polymerization method and the water-in-oil polymerization, saturated hydrocarbons, for example hexane, heptane, cyclohexane or decalin, or aromatic hydrocarbons, such as benzene, toluene, xylene and cumene, are used as the oil phase. The ratio of oil phase to aqueous phase in the inverse suspension polymerization is, for example, from 10:1 to 1:10.

A (co)polymer having a low K value, for example below 80, is obtained if the (co)polymerization is carried out in the presence of polymerization regulators or in a solvent which regulates the (co)polymerization, for example alcohols, such as methanol, ethanol, n-propanol or isopropanol, or ketones, such as acetone, methyl ethyl ketone, diethyl ketone or methyl isobutyl ketone.

(Co)polymers having low molecular weights and accordingly low K values are furthermore obtained with the aid of the conventional methods, i.e. the use of large amounts of polymerization initiator or use of polymerization regulators or combinations of said measures.

The molecular weight of the (co)polymers which can be used according to the invention is not limited. (Co)polymers having K values of from 30 to 110 are preferred, K values of from 40 to 90 being particularly preferred.

According to the invention, the (co)polymers containing N-alkyl-N-vinylcarboxamides, for example of the formula (I), and in particular N-vinylformamide, in the form of polymerized units can be used both in partly or completely cleaved form and in uncleaved form. A degree of hydrolysis of from 0 to 30% is preferred, particularly preferably from 0 to 20%, very particularly preferably from 0 to 10%. The methods of eliminating the carboxyl or formyl group are not limited and can be carried out, for example, in the presence of acid or base, the cleavage in the presence of bases, for example sodium hydroxide, potassium hydroxide, alkaline earth metal hydroxides, ammonia or amines, being preferred. Amphoteric (co)polymers can form as a result of partial hydrolysis, for example of a copolymer containing (meth)

acrylates and N-alkyl-N-vinylcarboxamides, for example of the formula (I), in the form of polymerized units.

Cationic copolymers of N-vinylformamide are obtained in a particularly simple manner by hydrolytically cleaving homopolymers of N-vinylformamide with defined amounts of acid or base to give the desired degree of hydrolysis, as described in EP-B1 071 050. The amino groups formed thereby on the polymer chain are more or less protonated, depending on the pH of the solution, and thus impart a more or less cationic character to the polymer.

If it is desired to eliminate the carboxyl group, this can be carried out, for example, in water.

The elimination of the formyl group in the hydrolysis is effected at from 20 to 200° C., preferably from 40 to 180° C., in the presence of acids or bases. The hydrolysis in the presence of acids and bases is preferably carried out at from 70 to 90° C.

From about 0.05 to 1.5 equivalents of an acid, such as hydrochloric acid, hydrobromic acid, phosphoric acid or sulfuric acid, are required per equivalent of carboxyl groups in the poly-N-alkyl-N-vinylcarboxamide for the acidic hydrolysis. The pH in the acidic hydrolysis is from 2 to 0, preferably from 1 to 0. The hydrolysis of N-vinylformamide takes place substantially more rapidly than that of (co)polymers of other N-alkyl-N-vinylcarboxamides, for example of N-methyl-N-vinylformamide, and can therefore be carried out under milder conditions, i.e. at lower temperatures and without a large excess of acids.

In addition, the hydrolysis of the formyl groups of the poly-N-alkyl-N-vinylcarboxamide can also be carried out in an alkaline medium, for example at a pH of from 11 to 14. This pH is preferably established by adding sodium hydroxide solution or potassium hydroxide solution. However, it is also possible to use ammonia, amines and/or alkaline earth metal bases. From 0.05 to 1.5, preferably from 0.4 to 1.0, equivalents of a base are used for the alkaline hydrolysis.

The cleavage can also be carried out at high temperatures, for example above 100° C., preferably from 120 to 180° C., particularly preferably from 140 to 160° C., in the presence of a solvent, e.g. water, without acid or base. This is preferably carried out under conditions above the critical point, for example using supercritical water.

In the hydrolysis (i.e. the carboxyl group is eliminated from the poly-N-vinylcarboxamide in water in the presence of acids or bases), carboxylic acid, for example formic acid, or a salt thereof is obtained as a byproduct.

The solutions obtained thereby can be used without further working-up in the novel process, but the hydrolysis or solvolysis products can also be separated off.

For the separation, the solutions obtained can be treated, for example, with ion exchangers. The residue separated off from the hydrolysis products can then be incorporated into the coating slip or used as activator for the pretreatment.

The molecular weight of the (co)polymers which can be used according to the invention is, as stated above, not limited, but it should be adapted to the respective coating method. The molecular weight should be relatively high for coating with, for example, a knife coater whereas it should be relatively low for coating with a spray means.

The application of the activators to the surface of the coating paper or precoated paper by the novel process can be effected by the methods customary for the surface treatment of paper in the paper industry. Known application units, for example film presses, size presses, various coating units comprising knife coaters, blades or air brushes, or spray means, as described, for example, for the application of starch in EP-A 373 276 or for the application of coating slips by V. Nissinen, Wochenblatt für Papierfabrikation 11/12 (2001), 794-806, may be used for this purpose. The application of the activators can, however, also be effected during the calendering of the paper via the humidification.

According to the invention, it is important that the activators be applied to the base paper or precoated paper in an operation before the application of the coating slip which contains optical brightener.

The application by means of a size press or, in the case of a plurality of coating operations, instead of a preliminary coat or middle coat is particularly preferred since a further operation can thus be saved.

The uncoated base paper which can be used for the novel pretreatment and may have been presized generally has a water content of not more than 10, preferably not more than 8, particularly preferably from 3 to 8, in particular from 5 to 8, % by weight.

The precoated paper which can be used for the novel pretreatment has generally undergone one or two coating operations.

The activators can be applied to the paper from aqueous solution or as a solution in methanol, ethanol, isopropanol, n-propanol, n-butanol, ethyl acetate, acetone or N-methylpyrrolidone, preferably from aqueous solution, and the concentration should be chosen so that the respective application method can be carried out optimally owing to, for example, the viscosity of the substance or solution to be applied.

Customary concentrations are from 10 to 60% by weight.

The activators can be applied to the paper as individual substances or as mixtures with one another. However, the activators can also be applied to the paper surface as a mixture with other paper chemicals which influence other paper properties. Such paper chemicals which can be applied to the paper together with the brightener activators according to the novel process are, for example, starch, cationic starch, other starch derivatives, e.g. hydroxyethyl, hydroxymethyl, methyl or ethyl starch ether, other polysaccharides, e.g. guar or guar derivatives, carboxymethyl-, hydroxyethyl-, hydroxymethyl-, methyl- or ethylcellulose ether or surface sizes.

Of course, in addition to at least one activator and, if required, solvent, the activator-containing material may also contain at least one pigment, at least one binder known per se and, if required, other assistants typical for paper (see below). However, optical brighteners are preferably only applied with a paper slip in a subsequent step (see below).

The amount in which the activator is applied to the paper according to the novel process can vary within wide limits. In general, an amount of from 0.05 to 5 g, preferably from 0.1 to 3 g, should be applied per $m^2$ of paper.

After the application of the activators to the base paper or precoated paper, drying can be effected, for example, by infrared lamps in order to remove any solvent present and, if desired, calendering can also be effected at from 15 to 100° C.

It has furthermore been found that the whiteness of the paper can frequently be further increased if, in addition to the pretreatment of the paper, a suitable activator for the optical brightener is added to the coating slip. This may be the same activator as that used for the pretreatment of the coating paper or for one of the preceding coats or another activator. Suitable activators are, for example, the abovementioned ones. Those (co)polymers which contain N-vinylcarboxamide, for example the abovementioned N-vinyl-N-alkylcarboxamides of the formula (I), in the form of polymerized units are preferred. Here too, the N-vinylcarboxamide-containing (co) polymers can be used both in partly or completely cleaved form and in uncleaved form. A degree of hydrolysis of from 0 to 30% is preferred, particularly preferably from 0 to 20%, very particularly preferably from 0 to 10%.

The amount of activator in the coating slip is chosen so that the viscosity of the coating slip is within ranges advantageous for processing technology. Usually, it is from 0.2 to 10%, based on the pigment in the coating slip.

The amount of (co)polymers containing N-alkyl-N-vinylcarboxamides, for example of the formula (I), which can be added to the paper coating slip depends on the amount of brightener in the coating slip.

Usually, from 0.2 to 2 parts by weight of the optical brighteners are added per 100 parts by weight of pigment in the coating slip. The amount of (co)polymer added to the coating slip is usually from the same amount as that of the optical brightener to five times the amount thereof, i.e. from 0.2 to 10, preferably from 0.5 to 8, particularly preferably from 1 to 5, parts by weight.

The paper coating slip applied after the novel pretreatment with an activator preferably contains at least one optical brightener.

In addition to the activator, the paper coating slips also contain at least one white pigment and at least one binder.

The paper coating slips may also contain further components known to a person skilled in the art. For example, leveling agents, thickeners, wetting assistants for the pigments, etc. are suitable.

The optical brighteners which can be used in combination with the novel process are not limited. For example, brighteners as described in Ullmann's Encyclopedia of Industrial Chemistry, Sixth Edition, 2000 Electronic Release, OPTICAL BRIGHTENERS—Chemistry of Technical Products may be used.

Suitable optical brighteners belong, for example, to the group consisting of the distyrylbenzenes, for example cyano-substituted 1,4-distyrylbenzenes having cyano groups in positions 2' and 3" [CAS-Reg No. 79026-03-2] or in positions 2' and 2" [13001-38-2], 3' and 3" [36755-00-7], 3' and 4" [79026-02-1] and 4' and 4"[13001-40-6], or amphoteric compounds, e.g. [84196-71-4], which carry one group each $$—O—(CH_2)_2—N^+(C_2H_5)_2—CH_2COO—$$

in positions 2' and 2", to the group consisting of the distyrylbiphenyls, for example 4,4'-di(2-sulfostyryl)biphenyl disodium salt [27344-41-8], 4,4'-di(3-sulfostyryl)biphenyl disodium salt [51119-63-2], 4,4'-di(4-chloro-3-sulfostyryl) biphenyl disodium salt [42380-62-1], 4,4'-di(6-chloro-3-sulfostyryl)biphenyl disodium salt [60477-28-3], 4,4'-di(2-methoxystyryl)biphenyl [40470-68-6] or a 4,4'-di(styryl) biphenyl which carries a group $$—O—(CH_2)_2—N^+(CH_3)(C_2H_5)_2.CH_3OSO_3—$$

in position 2 on the styryl radical [72796-88-4], to the group consisting of the divinylstilbenes, for example 4,4'-di (ethoxycarbonylvinyl)stilbene [60683-03-6] or 4,4'-di(cyanovinyl)stilbene [60682-87-3], to the group consisting of the triazinylaminostilbenes, e.g. 1,3,5-triazinyl derivatives of 4,4'-diaminostilbene-2,2'-disulfonic acid, such as anilino derivatives which carry the following radicals on the triazine rings, in each case in position 3: a methoxy radical (CAS-Reg No. [3426-43-5]), aminomethyl [35632-99-6], ethylamino [24565-13-7], hydroxyethylamino [12224-16-7], N-hydroxyethyl-N-methylamino [13863-31-5], bis(hydroxyethyl)amino [4193-55-9], morpholino [16090-02-1], phenylamino [133-66-4], N-2-aminocarbonylethyl-N-2-hydroxyethylamino [68444-86-0] or such as anilinosulfonic acid derivatives which carry the following radicals on the triazine rings, in each case in position 3: N-hydroxyethylamino and, additionally on the anilino group in position 5 of the triazine ring, a sulfo group in position 3 (CAS-Reg No. [61968-74-9]), N-bis(hydroxyethyl)amino and, additionally on the anilino group, a sulfo group in position 3 (CAS-Reg No. [12224-02-1]), N-bis(2-hydroxypropyl)amino and, additionally on the anilino group, a sulfo group in position 4 (CAS-Reg No. [99549-42-5]), N-bis(hydroxyethyl)amino and, additionally on the anilino group, a sulfo group in position 4 (CAS-Reg No. [16470-24-9]), N-hydroxyethyl-N-methyl-amino and, additionally on the anilino group, a sulfo group in position 4 (CAS-Reg No. [74228-28-7]), diethylamino and, additionally on the anilino group, sulfo groups in positions 2 and 5 (CAS-Reg No. [83512-97-4]), N-bis(hydroxyethyl)amino and, additionally on the anilino group, sulfo groups in positions 2 and 5 (CAS-Reg No. [76482-78-5]), or morpholino groups and, additionally on the anilino group, sulfo groups in positions 2 and 5 (CAS-Reg No. [55585-28-9]), or to the group consisting of the stilbenyl-2H-triazoles, e.g. stilbenyl-2H-naphtho[1,2-d]triazoles, such as the sodium salt of 4-(2H-naphtho[1,2-d]triazol-2-yl)stilbene-2-sulfonic acid [6416-68-8] or those which carry a sulfonic acid in position 6 on the naphthol ring and at position 2 of the stilbene skeleton [2583-80-4], or, on the stilbene skeleton, a cyano group in position 2 and a chloro group in position 4' [5516-20-1] or, for example, bis(1,2,3-triazol-2-yl)stilbenes, e.g. 4,4'-bis(4-phenyl-1,2,3-triazol-2-yl)stilbene-2,2'-disulfonic acid dipotassium salt [52237-03-3] or 4,4'-bis(4-(4'-sulfophenyl)-1,2,3-triazol-2-yl)stilbene-2,2'-disulfonic acid tetrasodium salt [61968-72-7], or to the group consisting of the benzoxazoles, e.g. stilbenylbenzoxazoles, for example 5,7-dimethyl-2-(4'-phenylstilben-4-yl)benzoxazole [40704-04-9], 5-methyl-2-(4'-(4"-methoxycarbonyl)-phenylstilben-4-yl)benzoxazole [18039-18-4] or those which carry other heterocycles in the 4" position, e.g. [64893-28-3], or bisbenzoxazoles, e.g. ethylene-, thiophene-, naphthylene-, phenylethylene- or stilbene-bridged bisbenzoxazoles, such as those having the CAS numbers [1041-00-5], [2866-43-5], [7128-64-5], [5089-22-5], [1552-46-1], [1533-45-5] or [5242-49-9].

It is furthermore possible to use furans, benzo[b]furans and benzimidazoles, e.g. bis(benzo[b]furan-2-yl)biphenyls, for example sulfonated 4,4'-bis(benzo[b]furan-2-yl)biphenyls or cationic benzimidazoles, for example 2,5-di(l-methylbenzimidazol-2-yl)furan [4751-43-3], [72829-17-5], [74878-56-1], [74878-48-1] or [66371-25-3], or 1,3-diphenyl-2-pyrazolines, e.g. 1-(4-amidosulfonylphenyl)-3-(4-chlorophenyl)-2-pyrazoline [2744-49-2], [60650-43-3], [3656-22-2], [27441-70-9], [32020-25-0], [61931-42-8] or [81209-71-4], and tertiary and quaternary amine salts of 1,3-diphenyl-2-pyrazoline derivatives, e.g. [106359-93-7], [85154-08-1], [42952-22-7], [63310-12-3], [12270-54-1] or [36086-26-7], and coumarins, e.g. 7-diethylamino-4-methylcoumarin [91-44-1] and [6025-18-9], [19683-09-1], [3333-62-8], [63660-99-1], [26867-94-7] or [52725-14-1] and naphthalimides, e.g. 4-acetylamino-N-(n-butyl)naphthalimide [3353-99-9], 4-methoxy-N-methylnaphthalimide [3271-05-4], [3271-05-4], [22330-48-9], [25826-31-7], [26848-65-7] or [60317-11-5] and 1,3,5-triazin-2-yl derivatives, for example (4,6-dimethoxy-1,3,5-triazin-2-yl)pyrene [3271-22-5] or 4,4'-di (4,6-diphenyl-1,3,5-triazin-2-yl)stilbene [6888-33-1].

4,4'-Distyrylbiphenyl derivatives or stilbene derivatives which are substituted by up to 6, particularly preferably by 2, 4 or 6, sulfo groups can preferably be used, preferably the Blankophor® grades from Bayer AG, particularly preferably Blankophor® P and Blankophor® PSG, furthermore preferably the Tinopal® grades from Ciba Specialty Chemicals, particularly preferably Tinopal® MC liquid, Tinopal® ABP-Z liquid, Tinopal® SPP-Z liquid and Tinopal® SK-B liquid, and furthermore preferably the Leukophor® grades from Clariant AG, particularly preferably Leukophor® APN, UO, NS or SHR.

The pigments which can be used in the coating slips are likewise not limited. For example, satin white (calcium sulfoaluminate), calcium carbonate in milled or precipitated form, barium sulfate in milled or precipitated form, kaolin (clay), calcined clay, talc, silicates or organic pigments, for example plastics in particulate form, can be used.

The binders which may be used in the novel coating slips ((co)polymeric binders) are likewise not limited. For example, casein, starch, soybean protein, carboxymethylcellulose, alginate and/or polyvinyl alcohol or dispersions which contain acrylic acid, acrylates, vinyl acetate and/or styrene in the form of polymerized units, for example acrylate/styrene, styrene/butadiene or vinyl acetate (co)polymers, can be used.

The paper coating slips may furthermore contain, for example, dispersants. Suitable dispersants are polyanions, for example of polyphosphoric acids or of polyacrylic acids (polysalts), which are usually present in amounts of from 0.1 to 3% by weight, based on the amount of pigment.

The paper coating slips are generally aqueous paper coating slips. The water content can be established according to the desired viscosity or leveling properties.

The water content in the paper coating slips is usually brought to 25 to 75% by weight, based on the total paper coating slip (including water).

The coating slips are processed completely analogously to the processing of coating slips according to the prior art, for example according to The Essential Guide to Aqueous Coating of Paper and Board, T. W. R. Dean (ed.), published by the Paper Industry Technical Association (PITA), 1997, Ratgeber für die Verwendung von BASF-Erzeugnissen in der Papier- und Kartonstreicherei, BASF Aktiengesellschaft, D-6700 Ludwigshafen, Germany, B 376 d, 09.77 or Ullmann's Encyclopädie der Technischen Chemie, 4th Edition, Vol. 17, page 603 et seq.

If required, a thickener may also be added. Suitable thickeners in addition to (co)polymers obtained by free radical (co)polymerization are conventional organic and inorganic thickeners, such as hydroxymethylcellulose or bentonite.

For the preparation of the paper coating slip, the components can be mixed in a known manner. The paper coating slips are suitable for coating, for example, paper or cardboard. The paper coating slips can then be applied by conventional methods to the papers or cardboard to be coated.

The papers or cardboards coated with the novel paper coating slips can be printed on by conventional processes, for example offset, letterpress or gravure printing processes, or by digital printing processes, e.g. laser printing or inkjet printing processes.

The novel process makes it easier for a person skilled in the art to carry out the difficult task of working out a coating slip formulation which conventionally also contains the brightener-enhancing activator in addition to the many other components influencing the rheology and the coating quality. It is known that, in addition to their brightener-enhancing effect, activators also change the properties of the coating slip and, owing to their interaction with the optical brighteners, even influence the rheological properties of the coating slip. Since, however, the coating slips may additionally contain thickeners, coat curing agents, leveling agents, gloss-imparting agents, flow improvers, dispersants, wetting agents, lubricants, etc. in addition to one or more pigments and in addition to one or more binders and the optical brighteners, a person skilled in the art is thankful for every component whose properties he does not have to take into account and which he need not incorporate into the coating slip.

The examples which follow illustrate the novel process without restricting it to these examples.

In this document, parts, percentages and ppm are by weight, unless stated otherwise.

EXAMPLES

Preparation of a Polyvinylformamide

Example A 715 g of distilled water, 1.92 g of phosphoric acid (75% strength) and 1.31 g of sodium hydroxide solution (25% strength) are initially taken in a stirred reactor having a nitrogen feed, a reflux condenser and a metering apparatus, so that a pH of about 6.5 is reached. The reactor is stirred and is heated to 75° C. Slightly reduced pressure is applied (about 400 mbar) and then 204.2 g of N-vinylformamide are added over a period of one hour. At the same time, 1.84 g of 2,2'-azobis(2-amidinopropane) dihydrochloride, dissolved in 50 g of water, are metered in over a period of 3 hours. After the addition of the initiator, polymerization is completed in the course of a further three hours. The polymer solution has a solids content of 20.2% and a K value of 67.

Example B

Hydrolysis of Example A

First 2.5 g of sodium bisulfite solution (40% strength) and then 22.9 g of sodium hydroxide solution (25% strength) are added to the same reactor as in example A. The reaction mixture is heated to 80° C., stirred for 3 hours and then cooled to 40° C. and 13.1 g of hydrochloric acid (30% strength) are added so that a pH of about 7 is reached. The slightly yellowish polymer solution has a degree of hydrolysis of 5% (enzymatic determination of the resulting formic acid).

Example C 971 g of distilled water, 3.37 g of phosphoric acid (75% strength) and 4.73 g of sodium hydroxide solution (25% strength) are initially taken in a stirred reactor having a nitrogen feed, a reflux condenser and a metering apparatus, so that a pH of about 6.5 is reached. The reactor is stirred and is heated to 75° C. Slightly reduced pressure is applied (about 400 mbar) and then 360 g of N-vinylformamide are added over a period of one hour. At the same time, 6 g of 2,2'-azobis (2-amidinopropane) dihydrochloride, dissolved in 50 g of water, are metered in over a period of 3 hours. After the addition of the initiator, polymerization is completed in the course of a further three hours. The polymer solution has a solids content of 35.3% and a K value of 45.9.

Example D

Hydrolysis of Example C

First 2.5 g of sodium bisulfite solution (40% strength) and then 32.4 g of sodium hydroxide solution (25% strength) are added to the same reactor as in example C. The reaction mixture is heated to 80° C., stirred for 3 hours and then cooled to 40° C. and 22.4 g of hydrochloric acid (30% strength) are added so that a pH of about 7 is reached. The slightly yellowish polymer solution has a degree of hydrolysis of 5.4% (enzymatic determination of the resulting formic acid).

Example E 690 g of distilled water, 3.73 g of phosphoric acid (75% strength) and 5.25 g of sodium hydroxide solution (25% strength) are initially taken in a stirred reactor having a nitrogen feed, a reflux condenser and a metering apparatus, so that a pH of about 6.5 is reached. The reactor is stirred and is heated to 75° C. Slightly reduced pressure is applied (about 400 mbar) and then 400 g of N-vinylformamide are added over a period of one hour. At the same time, 20 g of 2,2'-azobis (2-amidinopropane) dihydrochloride, dissolved in 135 g of water, are metered in over a period of 3 hours. After the addition of the initiator, polymerization is completed in the course of a further three hours. The polymer solution has a solids content of 45.3% and a K value of 30.5.

Example F

Hydrolysis of Example E

First 2.5 g of sodium bisulfite solution (40% strength) and then 45 g of sodium hydroxide solution (25% strength) are added to the same reactor as in example 1. The reaction mixture is heated to 80° C., stirred for 3 hours and then cooled to 40° C. and 30.8 g of hydrochloric acid (30% strength) are added so that a pH of about 7 is reached. The slightly yellowish polymer solution has a degree of hydrolysis of 4.3% (enzymatic determination of the resulting formic acid).

Example 1

A commercial wood-free coating paper having the optical properties stated in table 1 was coated with 15 g/m$^2$ of a coating slip by means of a manual knife coater. The coating slip contained 33% of water. The nonaqueous fraction consisted of 70 parts of calcium carbonate (Hydrocarb® 90 from Plüss-Staufer AG), 30 parts of kaolin (Amazon® 88, from Kaolin International), 8 parts of a polymer dispersion based on styrene and butadiene as a binder (Styronal® D 610, BASF Aktiengesellschaft), 0.5 part of a 1,3,5-triazinyl derivative of 4,4'-diaminostilbene-2,2'-disulfonic acid having 2 sulfo groups (Tinopal® MC liquid from Ciba Specialty Chemicals) as an optical brightener and, if required, 2 parts of a polyvinylformamide from example D which acts as a rheology assistant, binding power improver and activator for the brightener and has a K value of 45.9 and a degree of hydrolysis of 5.4%. With this amount of activator (2%) which, if required, is added to the coating slip, sufficient viscosity of the coating slip for processing is still achieved.

The coated paper was dried according to the prior art, calendered, and investigated as follows:

The R 457 whiteness of the paper was determined according to DIN 53 145, Part 2.

The CIE whiteness of the paper was measured according to ISO 2469.

According to the novel process, a 10% strength aqueous solution of a polyvinylformamide having a K value of 45.9 and a degree of hydrolysis of 5.4% (see above, example D) was applied by means of a manual knife coater to the coating paper prior to coating with the coating slip, so that, after drying, 2 g/m$^2$ of the polyvinylformamide remained on the paper. The following papers were compared with one another in table 1:

I: Coating paper

II: Paper coated with the coating slip which contains no activator.

III: Paper coated with the coating slip which contains 2 parts of polyvinylformamide from example D, having a K value of 45.9 and a degree of hydrolysis of 5.4%, as an activator.

IV: Paper according to the process of the invention, which has been pretreated with the polyvinylformamide and has been coated with a coating slip which contains no activator.

V: Paper according to the process of the invention which has been pretreated with the polyvinylformamide but which additionally contains 2 parts of polyvinylformamide from example D, having a K value of 45.9 and a degree of hydrolysis of 5.4%, as an activator in the coating slip.

In table 1, the very great extent to which the paper whiteness increases through the use of the novel process is evident to a person skilled in the art from a comparison of lines II and IV. From a comparison of lines III and IV, it is evident that the use of the activator in the coating slip fails by far to achieve the high degree of whiteness as in the novel process. From a comparison of lines IV and V, it is evident that the whiteness of the paper can be further increased by the novel process if, in addition to the pretreatment of the paper, a suitable activator is added to the coating slip. From a comparison of lines III and V, the considerable effect of the novel process is once again evident.

TABLE 1

| | R 457 whiteness | CIE whiteness |
|---|---|---|
| I: Coating paper | 90.50 | 98.3 |
| II: Paper coated with coating slip (without activator) | 91.19 | 100.4 |
| III: Paper coated with coating slip (incl. activator) | 97.17 | 115.6 |
| IV: Paper pretreated with activator, coated with coating slip (without activator) (according to the invention) | 100.62 | 124.4 |
| V: Paper pretreated with activator, coated with coating slip (incl. activator) (according to the invention) | 102.67 | 129.8 |

Example 2

The procedure was as in example 1, except that a 1,3,5-triazinyl derivative of 4,4'-diaminostilbene-2,2'-disulfonic acid having 4 sulfo groups (Tinopal® ABP-Z liquid from Ciba Specialty Chemicals) was used as the optical brightener.

From table 2, it is evident that the advantages of the novel process also occur when an optical brightener having 4 sulfo groups is used.

TABLE 2

| | R 457 whiteness | CIE whiteness |
|---|---|---|
| I: Coating paper | 90.50 | 98.3 |
| II: Paper coated with coating slip (without activator) | 91.52 | 98.0 |
| III: Paper coated with coating slip (incl. activator) | 99.14 | 117.7 |
| IV: Paper pretreated with activator, coated with coating slip (without activator) (according to the invention) | 105.28 | 131.6 |

TABLE 2-continued

| | R 457 whiteness | CIE whiteness |
|---|---|---|
| V: Paper pretreated with activator, coated with coating slip (incl. activator) (according to the invention) | 107.07 | 136.1 |

Example 3

The procedure was as in example 1, except that a 1,3,5-triazinyl derivative of 4,4'-diaminostilbene-2,2'-disulfonic acid having 6 sulfo groups (Tinopal® SPP-Z liquid from Ciba Specialty Chemicals) was used as the optical brightener and that, if required, 1.5 parts of an unhydrolyzed polyvinylformamide from example C, acting as a rheology assistant, binding power improver and activator for the brightener and having a K value of 45.9, ere added.

From table 3, it is evident that the advantages of the novel process occur even when an optical brightener having 6 sulfo groups is used. Furthermore, it is evident that the presence of an additional activator which differs from that with which the coating paper was treated can further increase the whiteness of the coated paper.

TABLE 3

| | R 457 whiteness | CIE whiteness |
|---|---|---|
| I: Coating paper | 90.50 | 98.3 |
| II: Paper coated with coating slip (without activator) | 94.02 | 107.3 |
| III: Paper coated with coating slip (incl. activator) | 100.74 | 124.3 |
| IV: Paper pretreated with activator, coated with coating slip (without activator) (according to the invention) | 105.98 | 136.8 |
| V: Paper pretreated with activator, coated with coating slip (incl. activator) (according to the invention) | 106.84 | 139.2 |

Example 4

A commercial wood-free coating paper having the optical properties stated in table 1 was coated with 15 g/m$^2$ of a coating slip by means of a manual knife coater. The coating slip contained 33% of water. The nonaqueous fraction consisted of 70 parts of calcium carbonate (Hydrocarb® 90, Plüss-Staufer AG), 30 parts of kaolin (Amazon® 88, obtained through Kaolin International), 8 parts of a polymer dispersion based on styrene and butadiene as a binder (Styronal® D 610, BASF Aktiengesellschaft), 0.5 part of a 1,3,5-triazinyl derivative of 4,4'-diaminostilbene-2,2'-disulfonic acid having 4 sulfo groups (Tinopal® ABP-Z liquid from Ciba Specialty Chemicals) as an optical brightener and in each case 1.0 part, 1.5 parts and 2.0 parts of the following activators:

Polyvinylformamide having a K value of 45.9, unhydrolyzed Polyvinylformamide having a K value of 45.9 and a degree of hydrolysis of 5.4%.

A 10% strength aqueous solution of a polyvinylformamide from example D having a K value of 45.9 and a degree of hydrolysis of 5.4% (see above) was applied by means of a manual knife coater according to the novel process to the coating paper prior to coating with the coating slip, so that, after drying, 2 g/m$^2$ of the polyvinylformamide remained on the paper.

In table 4, papers which were coated with coating slips which contained the different activators in various amounts were compared with one another.

TABLE 4

| All coating papers pretreated according to the invention with activator | R 457 whiteness | CIE whiteness |
|---|---|---|
| I: Coating paper without activator | 105.28 | 131.6 |
| II: Coating slip containing 1.0 part of unhydrolyzed polyvinylformamide as activator | 105.87 | 134.4 |
| III: Coating slip containing 1.5 parts of unhydrolyzed polyvinylformamide as activator | 106.12 | 135.4 |
| IV: Coating slip containing 2.0 parts of unhydrolyzed polyvinylformamide as activator | 106.54 | 136.6 |
| V: Coating slip containing 1.0 part of polyvinylformamide, degree of hydrolysis 5.4%, as activator | 105.50 | 133.1 |
| VI: Coating slip containing 1.5 parts of polyvinylformamide, degree of hydrolysis 5.4%, as activator | 105.97 | 134.1 |
| VII: Coating slip containing 2.0 parts of polyvinylformamide, degree of hydrolysis 5.4%, as activator | 107.07 | 136.1 |

It is evident from table 4, lines II to VII, that the whiteness of the paper can be increased if, in addition to the pretreatment of the coating paper, a suitable activator is added to the coating slip.

Example 5

A commercial wood-free coating paper having the optical properties stated in table 1 was coated with 15 g/m$^2$ of a coating slip by means of a manual knife coater. The coating slip contained 33% of water. The nonaqueous fraction consisted of 70 parts of calcium carbonate (Hydrocarb® 90, Plüss-Staufer AG), 30 parts of kaolin (Amazon® 88, obtained through Kaolin International), 8 parts of a polymer dispersion based on styrene and butadiene as a binder (Styronal® D 610, BASF Aktiengesellschaft) and 0.5 part of a 1,3,5-triazinyl derivative of 4,4'-diaminostilbene-2,2'-disulfonic acid having 6 sulfo groups (Tinopal® SPP-Z liquid from Ciba Specialty Chemicals) as an optical brightener.

Either the coating paper used was not pretreated or the various activators were applied to the coating paper by the technique described in example 1.

The base papers were treated with the following activators before they were coated with the activator-free coating slip:

Polyvinylformamide from example D, having a K value of 45.9 and a degree of hydrolysis of 5.4%

Polyvinylformamide from example C, having a K value of 45.9, unhydrolyzed

Polyvinylpyrrolidone (Lumiten® P-PR 8450, BASF Aktiengesellschaft)

Polyvinyl alcohol (Rhodoviol® R4/20, from Rhodia)

TABLE 5

| Coating paper | R 457 whiteness | CIE whiteness |
|---|---|---|
| without pretreatment | 95.92 | 110.6 |
| with polyvinylformamide from example D, degree of hydrolysis 5.4% | 106.61 | 136.5 |
| with polyvinylformamide from example C, unhydrolyzed | 107.64 | 139.3 |
| with polyvinylpyrrolidone | 103.42 | 133.8 |
| with polyvinyl alcohol | 101.77 | 127.7 |

From table 5, it is evident that many different activators for optical brighteners can be used for the novel process.

Example 6

The procedure was as in example 1, except that a derivative of 4,4'-distyrylbiphenyl (Tinopal® SK-B liquid from Ciba Specialty Chemicals) was used as the optical brightener and that, if required, 1.0 part of an unhydrolyzed polyvinylformamide from example C, acting as a rheology assistant, binding power improver and activator for the brightener and having a K value of 45.9, was added to the coating slip.

TABLE 6

| | R 457 whiteness | CIE whiteness |
|---|---|---|
| I: Coating paper | 90.50 | 98.3 |
| II: Paper coated with coating slip (without activator) | 94.10 | 109.1 |
| III: Paper coated with coating slip (incl. unhydrolyzed polyvinylformamide as activator) | 96.79 | 115.0 |
| IV: Paper pretreated with activator, coated with coating slip (without activator) (according to the invention) | 99.75 | 121.6 |
| V: Paper pretreated with activator, coated with coating slip (incl. unhydrolyzed polyvinylformamide as activator) (according to the invention) | 100.67 | 124.3 |

From table 6, it is evident that the novel process is advantageous even when optical brighteners of a different chemical nature are used, for example those based on derivatives of 4,4'-distyrylbiphenyl.

Example 7

A paper coated with a pigment-containing coating slip (precoated paper) was provided with a top coat by coating with a pigment-containing coating slip which contained 33% of water. The nonaqueous fraction of the coating slip consisted of 70 parts of calcium carbonate (Hydrocarb® 90 from Plüss-Staufer AG), 30 parts of kaolin (Amazon® 88, obtained through Kaolin International), 8 parts of a polymer dispersion based on styrene and butadiene as a binder (Styronal® D 610 from BASF Aktiengesellschaft) and 0.5 part of a 1,3,5-triazinyl derivative of 4,4'-diaminostilbene-2,2'-disulfonic acid having 6 sulfo groups (Tinopal® SPP-Z liquid from Ciba Specialty Chemicals) as an optical brightener. According to the novel process, the polymers stated in table 7 were applied by means of a manual knife coater in an amount of 1 g/m$^2$ to the precoated paper prior to coating the precoated paper with the coating slip for the top coat.

The paper provided with the top coat was dried according to the prior art, calendered and investigated. The R 457 whiteness of the paper was determined according to DIN 53 145, Part 2. The CIE whiteness of the paper was measured according to ISO 2469. The opacity was determined according to DIN 53146.

TABLE 7

| Precoated paper treated | R 457 whiteness of the paper with top coat | CIE whiteness of the paper with top coat | Opacity of the paper with top coat |
|---|---|---|---|
| without pretreatment | 93.39 | 105.9 | 89.70 |
| with polyvinyl alcohol (Rhodoviol ® R4/20) | 99.56 | 122.9 | 89.88 |
| with polyvinylpyrrolidone (Lumiten ® P-PR 8450) | 102.62 | 132.7 | 91.02 |
| Polyvinylformamide from example E, K value 30.5 | 105.40 | 134.9 | 90.87 |
| Polyvinylformamide from example F, K value 30.5, degree of hydrolysis 4.3% | 104.13 | 131.6 | 90.78 |
| Polyvinylformamide from example C, K value 45.9 | 106.42 | 137.6 | 90.94 |
| Polyvinylformamide from example D, K value 45.9, degree of hydrolysis 5.4% | 103.94 | 131.3 | 91.19 |
| Polyvinylformamide from example A, K value 67 | 105.83 | 136.1 | 91.12 |
| Polyvinylformamide from example B, K value 67, degree of hydrolysis 5.0% | 101.97 | 126.4 | 91.10 |

From table 7, it is evident to a person skilled in the art that an enhancement of the optical brightness in the top coat and an increase in the opacity are also obtained if the activators are applied to a coated paper before the pigment-containing and brightener-containing top coating slip is applied.

We claim:

1. A process for the production of coated paper, comprising:

initially coating a base paper or precoated paper with a first layer of a composition consisting of at least one polymer or copolymer which contains at least one N-vinylcarboxamide in the form of polymerized units or said polymer or copolymer combined with an activator; and coating the first layer coated paper with a paper slip coating composition that contains an optical brightener component, thereby producing an at least two layer coated paper product having an optical brightness that is enhanced because of the presence of the coated composition of said first layer.

2. The process as claimed in claim 1, wherein the coating slip composition contains at least one pigment.

3. The process as claimed in claim 1, wherein said N-vinylcarboxamide is N-vinylformamide, N-vinylacetamide, N-vinylpropionamide, N-vinylbutyramide, N-vinylisobutyramide, N-vinyl-2-ethylhexanamide, N-vinyldecanamide, N-vinyldodecanamide, N-vinylstearamide, N-methyl-N-vinylformamide, N-methyl-N-vinylacetamide, N-methyl-N-vinylpropionamide, N-methyl-N-vinylbutyramide, N-methyl-N-vinylisobutyramide, N-methyl-N-vinyl-2-ethylhexanamide, N-methyl-N-vinyldecanamide, N-methyl-N-vinyldodecanamide, N-methyl-N-vinylstearamide, N-ethyl-N-vinylformamide, N-ethyl-N-vinylacetamide, N-ethyl-N-vinylpropionamide, N-ethyl-N-vinylbutyramide, N-ethyl-N-vinylisobutyramide, N-ethyl-N-vinyl-2-ethylhexanamide, N-ethyl-N-vinyldecanamide, N-ethyl-N-vinyldodecanamide, N-ethyl-N-vinylstearamide, N-isopropyl-N-vinylformamide, N-isopropyl-N-vinylpropionamide, N-isopropyl-N-vinylacetamide, N-isopropyl-N-vinylbutyramide, N-isopropyl-N-vinylisobutyramide, N-isopropyl-N-vinyl-2-ethylhexanamide, N-isopropyl-N-vinyldecanamide, N-isopropyl-N-vinyldodecanamide, N-isopropyl-N-vinylstearamide, N-n-butyl-N-vinylformamide, N-n-butyl-N-vinylacetamide, N-n-butyl-N-vinyipropionamide, N-n-butyl-N-vinylbutyramide, N-n-butyl-N-vinylisobutyramide, N-n-butyl-N-vinyl-2-ethylhexanamide, N-n-butyl-N-vinyldecanamide, N-n-butyl-N-vinyldodecanamide, N-n-butyl-N-vinylstearamide, N-vinylpyrrolidone or N-vinylcaprolactam.

4. The process as claimed in claim 3, wherein said N-vinylcarboxamide is N-vinylformamide, N-vinylacetamide, N-methyl-N-vinylformamide, N-methyl-N-vinylacetamide, N-vinylpyrrolidone or N-vinylcaprolactam.

5. The process as claimed in claim 1, wherein the N-vinylcarboxamide units in the copolymer or polymer which contains the N-vinylcarboxamide is partially cleaved.

6. The process as claimed in claim 1, wherein the precoating of a paper is formed from a composition that contains a polyvinyl alcohol, carboxymethylcellulose, an anionic or nonionic degraded starch, casein, soybean protein, a water-soluble styrene/acrylate copolymer or an acrylate-containing copolymer component.

7. The process as claimed in claim 1, wherein the coating slip composition contains an optical brightener which is a (co)polymer that contains polymerized units of at least one N-vinylcarboxamide.

8. The process as claimed in claim 1, wherein said substance which enhances the efficiency of optical brighteners is a copolymer prepared by the (co)polymerization of:

(a) from 5 to 100 mol % of at least one N-vinylcarboxamide of the formula:

(I)

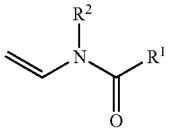

wherein $R^1$ and $R^{2,}$ independently of one another, are hydrogen or straight-chain or branched $C_1$- to $C_{20}$-alkyl, (b) from 0 to 95 mol % of monoethylenically unsaturated carboxylic acids of 3 to 8 carbon atoms and/or their alkali metal and ammonium salts, and optionally (c) up to 30 mol % of other monoethylenically unsaturated compounds which are copolymerizable with monomers (a) and (b), and optionally (d) up to 2 mol % of at least one compound that has at least two ethylenically unsaturated non-conjugated double bonds in the molecule, the sum of the monomer components being 100%.

9. The process as claimed in claim 1, wherein said substance which enhances the efficiency of optical brighteners is a copolymer prepared by the (co)polymerization of:

(a) from 30 to 100 mol % of N-vinylformamide, N-vinylacetamide, N-methyl-N-vinylformamide, N-methyl-N-vinylacetamide, N-vinylpyrrolidone, N-vinylcaprolactam or mixtures thereof, (b) from 70 to 0 mol % of acrylic acid, (meth)acrylic acid, and/or their alkali metal, alkaline earth metal, ammonium or amine salts or mixtures thereof, and (c) from 0 to 30 mol % of acrylamide, acrylonitrile, vinyl acetate, N-vinylimidazole or mixtures thereof, the sum of the monomer components being 100%.

10. A coated paper obtained by the process as claimed in claim 1.

11. A process for the production of coated paper, comprising:

initially coating a base paper or precoated paper with a first layer of a composition consisting of a (co)polymer which contains at least one N-vinylcarboxamide of formula (I) in the form of polymerized units or said (co) polymer combined with an activator;

(I)

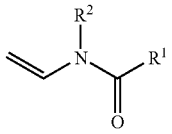

wherein $R^1$ and $R^{2,}$ independently of one another, are hydrogen or straight-chain or branched $C_1$- to $C_{20}$-alkyl; and coating the first layer coated paper with a paper slip coating composition that contains an optical brightener component, thereby producing a coated paper product having an optical brightness that is enhanced because of the presence of the coated composition of said first layer.

12. A process for the production of coated paper, comprising:

initially coating a base paper or precoated paper with a first layer of a composition consisting of at least one polymer or copolymer which contains at least one N-vinylcarboxamide in the form of polymerized units or said polymer or copolymer combined with an activator; and coating the first layer paper with a paper slip coating composition that contains an optical brightener component and a binder that is selected from the group consisting of casein, starch, soybean protein, carboxymethylcellulose, alginate, polyvinyl alcohol and combinations thereof or a binder that is a dispersion that contains one or more of acrylic acid, acrylates, vinyl acetate and styrene, thereby producing an at least two layer coated paper product that has an optical brightness which is enhanced by the presence of the coated composition of said first layer.

13. A process for the production of coated paper, consisting of:

initially coating a base paper or coated paper with a first layer of a composition consisting of (i) at least one polymer or copolymer which contains at least one N-vinylcarboxamide in the form of polymerized units; and coating the first layer coated paper with a paper slip coating composition that contains an optical brightener component, thereby producing an at least two layer coated paper product that has an optical brightness which is enhanced by the presence of the coated composition of said first layer.

* * * * *